US010953253B2

(12) United States Patent
Pohl

(10) Patent No.: US 10,953,253 B2
(45) Date of Patent: Mar. 23, 2021

(54) ALARM VALVE STATION OF A FIRE EXTINGUISHING SYSTEM, AND FIRE EXTINGUISHING SYSTEM

(71) Applicant: MINIMAX GMBH & CO. KG, Bad Oldesloe (DE)

(72) Inventor: Matthias Pohl, Stubben (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 120 days.

(21) Appl. No.: 15/998,941

(22) PCT Filed: Dec. 20, 2016

(86) PCT No.: PCT/EP2016/081848
§ 371 (c)(1),
(2) Date: Aug. 17, 2018

(87) PCT Pub. No.: WO2017/140402
PCT Pub. Date: Aug. 24, 2017

(65) Prior Publication Data

US 2020/0139176 A1 May 7, 2020

(30) Foreign Application Priority Data

Feb. 17, 2016 (DE) ..... 10 2016 202 441.8

(51) Int. Cl.
*A62C 35/68* (2006.01)
*A62C 35/60* (2006.01)
(Continued)

(52) U.S. Cl.
CPC ..... *A62C 35/68* (2013.01); *A62C 35/60* (2013.01); *A62C 35/605* (2013.01); *A62C 35/64* (2013.01); *G08B 17/04* (2013.01)

(58) Field of Classification Search
CPC ..... A62C 35/60; A62C 35/68; A62C 35/64; A62C 35/605; G08B 17/04; G08B 17/00
See application file for complete search history.

(56) References Cited

U.S. PATENT DOCUMENTS 711,960 A 10/1902 Gray
1,738,656 A * 12/1929 Lowe ..... A62C 35/605 169/23
(Continued)

FOREIGN PATENT DOCUMENTS

CN 104436504 A 3/2015
DE 10 2007 049 588 A1 4/2009
(Continued)

OTHER PUBLICATIONS

International Search Report and Written Opinion (with English translation), International Application No. PCT/EP2016/081848 (published under WO 2017/140402), 14 pages (dated Mar. 30, 2017).
(Continued)

*Primary Examiner* — Joseph A Greenlund
(74) *Attorney, Agent, or Firm* — Perkins Coie LLP

(57) ABSTRACT

The invention relates to an alarm valve station (1), in particular a wet alarm valve station, of a fire extinguishing system (100), having an alarm valve (3) with an extinguishing fluid inlet (5) and an extinguishing fluid outlet (7), wherein the alarm valve (3) has a closing body that can be moved back and forth between a blocking state and a release state, wherein the fluid inlet chamber and the fluid outlet chamber are separated from one another in the blocking state and communicate with one another fluidically in the release state, an alarm triggering device (9) for triggering a fire alarm, which is connected with the alarm valve (3), and a delay container (11*a*, 11*b*) in order to delay triggering of the fire alarm, wherein the alarm valve (3) is fluidically con-
(Continued)

nected with a fluid inlet (13) of the delay container, and a fluid outlet (15*a*-15*c*) of the delay container (11*a,* 11*b*) is fluidically connected with the alarm triggering device (9). The invention proposes that the delay container (11*a,* 11*b*) have several fluid inlets (13) and/or several fluid outlets (15*a*-15*c*).

22 Claims, 9 Drawing Sheets

(51) Int. Cl.
*A62C 35/64* (2006.01)
*G08B 17/04* (2006.01)

(56) References Cited

U.S. PATENT DOCUMENTS 2,505,761 A 5/1950 Gieseler
2,537,009 A * 1/1951 Allen ..... A62C 99/009 169/9
3,083,943 A * 4/1963 Stewart, Jr. ..... F16K 31/1266 251/61.1
3,168,281 A * 2/1965 Yates ..... F16K 3/28 251/327
5,632,465 A * 5/1997 Cordua ..... F16K 7/126 251/30.02
5,720,351 A * 2/1998 Beukema ..... A62C 35/62 169/16
7,878,258 B2 * 2/2011 Lindstrom ..... A62C 35/02 169/61
8,307,906 B2 * 11/2012 Reilly ..... A62C 37/50 169/20
2011/0108290 A1 * 5/2011 Feenstra ..... A62C 35/68 169/16
2017/0037975 A1 * 2/2017 Weingarten ..... F16K 7/17
2018/0043197 A1 * 2/2018 Ringer ..... A62C 35/68
2018/0147433 A1 * 5/2018 Williams ..... A62C 35/60
2018/0361184 A1 * 12/2018 Pohl ..... A62C 37/36
2019/0388718 A1 * 12/2019 Pohl ..... A62C 35/605
2020/0139176 A1 * 5/2020 Pohl ..... A62C 35/60

FOREIGN PATENT DOCUMENTS

DE 20 2012 005 539 U1 8/2012
GB 327676 4/1930

OTHER PUBLICATIONS

Office Action with English translation, Chinese Application No. 201680082023.9, 23 pages (dated Mar. 4, 2020).
Li, "Supervision on Design and Construction of Fire Water Supply System for Building," first edition, China Building Materials Industry Press, pp. 113-115 (Jan. 31, 2003).

* cited by examiner

ALARM VALVE STATION OF A FIRE EXTINGUISHING SYSTEM, AND FIRE EXTINGUISHING SYSTEM

PRIORITY CLAIM AND INCORPORATION BY REFERENCE

This application is a 35 U.S.C. § 371 application of International Application No. PCT/EP2016/081848, filed Dec. 20, 2016, which claims the benefit of German Application No. 10 2016 202 441.8, filed Feb. 17, 2016, each of which is incorporated by reference in its entirety.

TECHNICAL FIELD

The invention relates to an alarm valve station, in particular to a wet alarm valve station, of a fire extinguishing system, having an alarm valve with an extinguishing fluid inlet and an extinguishing fluid outlet, wherein the alarm valve has a closing body that can be moved back and forth between a blocking state and a release state, wherein the fluid inlet chamber and the fluid outlet chamber are separated from one another in the blocking state and communicate with one another fluidically in the release state, an alarm triggering device for triggering a fire alarm, which is connected with the alarm valve, and a delay container in order to delay triggering of the fire alarm, wherein the alarm valve is fluidically connected with a fluid inlet of the delay container, and a fluid outlet of the delay container is connected with the alarm triggering device. The invention further relates to a fire extinguishing system with such an alarm valve station.

BACKGROUND AND SUMMARY OF THE INVENTION

Alarm valve stations of fire extinguishing systems are used to trigger a fire alarm. To this end, known alarm valve stations routinely determine the fluidic flow of the extinguishing fluid between the extinguishing fluid inlet, which is usually fluidically connected with an extinguishing fluid supply, and the extinguishing fluid outlet, which is usually fluidically connected with a sprinkler arrangement via a fluid line system.

In the event of a fire, the sprinkler nozzles of the sprinkler arrangement open, thereby causing a drop in the pressure level in the line system of the sprinkler arrangement, and thus also at the extinguishing fluid outlet of the alarm valve. The pressure drop results in a pressure difference forming between the extinguishing fluid inlet and extinguishing fluid outlet of the alarm valve. Once a specific pressure difference has been reached, the closing body, which is arranged in the alarm valve and closed with the alarm valve in the idle state, opens.

At the same time that the closing body between the extinguishing fluid inlet and extinguishing fluid outlet opens, the extinguishing fluid inflow from inside of the alarm valve is released, for example in a stub line, which usually is referred to as an alarm line. The stub line is (nearly) fluid-free and unpressurized in the idle state of the closing body. In addition, the stub line is fluidically connected with a pressure sensor, which detects the pressure change in the stub line caused by the inflowing extinguishing fluid. The pressure sensor is part of an alarm triggering device.

The supply of extinguishing fluid is subject to temporarily arising pressure fluctuations, for example owing to water hammers in the supply network. These pressure fluctuations can result in the stub line, which is fluidically connected with the pressure sensor, being briefly pressurized by extinguishing fluid. To prevent pressure fluctuations in the extinguishing fluid supply from triggering a fire alarm, a hydraulic delay container is routinely placed upstream from the pressure sensor. As a result of the delay container, a pressure interpreted as an event for generating an alarm signal only builds at the pressure sensor if a large enough amount of extinguishing fluid flows into the alarm line or delay container, and a corresponding pressure builds at the pressure sensor. This prevents temporarily arising pressure fluctuations in the extinguishing fluid supply from leading to an inadvertent triggering of a fire alarm.

In several alarm valve stations, the fluid outlet of known delay containers is fluidically connected with several separate components, for example with several different or identical pressure sensors and/or with alarm systems like alarm bells. To this end, the delay container is connected with branch lines, which distribute the extinguishing fluid pressure or extinguishing fluid flow present at the delay container. For this purpose, use is usually made of various fittings, such as T-shaped or Y-shaped line branches arranged at the fluid outlet of the delay container. This produces a high assembly and maintenance outlay on the one hand, while on the other this type of line arrangement leads to an increased risk of a leak, and hence of a functional impairment or even a functional failure.

The object underlying the invention is to provide the capacity to fluidically connect the delay container of an alarm valve station (outlet side) with several separate components, while lowering the assembly and maintenance outlay and/or risk of leakage by comparison to known solutions, and arranging the delay container inside of the alarm valve station so as to economize on space.

The object is achieved with an alarm valve station of the kind mentioned at the outset, wherein the delay container has several fluid inlets and/or several fluid outlets.

The invention makes use of the knowledge that the fluid flow or pressure need not necessarily be divided outside of the delay container by a suitable line arrangement. Dividing the fluid flow with the delay container eliminates the need for a downstream line arrangement for dividing the fluid flow. This reduces the assembly and maintenance outlay, as well as the risk of a leak, and in particular also significantly reduces the space required.

The extinguishing fluid inlet of the alarm valve is preferably set up to be fluidically connected with an extinguishing fluid supply. Alternatively or additionally, the extinguishing fluid outlet of the alarm valve is set up to be fluidically connected with a sprinkler arrangement. Further preferred is a delay container having two, three or four fluid inlets and/or two, three or four fluid outlets.

The alarm valve station according to the invention is advantageously further developed so as to connect one fluid outlet or several or all of the several fluid outlets of the delay container with one or several respective alarm triggering devices. According to the invention, the alarm triggering device is understood as the functional unit that comprises the acquisition of an event requiring the generation of the alarm signal, e.g., the sufficient rise in pressure in the delay container, as well as means for generating the alarm signal. At least one alarm triggering device preferably consists of a pressure sensor, which is set up to detect a pressure change and convert it into an electrical signal. The pressure sensor is preferably designed as a pressure switch.

The pressure sensor is preferably connected with a fire detector and/or extinguishing control panel in a signal-conducting manner. The fire detector and extinguishing control panel preferably processes the signal received from the pressure sensor, so as to control alarm systems, such as one or several electrically operated alarm horns or one or several hydraulically operated alarm bells, and/or to transmit alarm messages to permanently manned locations and the fire department. The fire detector and/or extinguishing control panel preferably continuously monitors the fire extinguishing system in which the alarm valve station according to the invention is used. In particular, the fire detector and/or extinguishing control panel communicates with hazard management systems and, by way of web interfaces, with internet-ready devices.

In another preferred embodiment of the alarm valve station according to the invention, the pressure sensor is alternatively or additionally connected with an electrically operated alarm system in a signal-conducting manner. The electrically operated alarm system preferably consists of an alarm horn.

In another preferred embodiment of the alarm valve station according to the invention, at least one alarm triggering device has a hydraulically operated alarm system. The hydraulically operated alarm system preferably has a hydraulic alarm bell. The alarm bell serves to sound an alarm in the immediate environment.

In an especially preferred embodiment of the alarm valve station according to the invention, several fluid outlets are arranged on a first side of the delay container, and at least one fluid inlet is arranged on a second, opposing side of the delay container. Because several fluid outlets are arranged on the first side of the delay container, and at least one fluid inlet is arranged on the second, opposing side of the delay container, the extinguishing fluid can be introduced into the delay container via the at least one fluid inlet on the second side of the delay container. After the delay container is completely or essentially completely filled with extinguishing fluid, extinguishing fluid flows through the several fluid outlets on the first side of the delay container and out of the delay container, or the pressure being built up by the fluid streaming into the delay container continues to the fluid outlets. As a result of the opposing arrangement of the at least one fluid inlet and the several fluid outlets, the entire or essentially the entire volume of the delay container is thus utilized, so that a maximum delay is achieved. A fluid outlet is preferably arranged on the second side of the delay container in addition to the fluid inlet. The additional fluid outlet on the second side of the delay container allows the delay container to be emptied, for example. The delay container is preferably emptied continuously, but with a slow evacuation rate. This ensures that an evacuation process will take place after a complete or partial filling of the delay container, so that the entire volume of the delay container is available during subsequent filling for delaying the hydraulic signal. It is further preferred that the delay container be aligned in such a way that the second side of the delay container, and hence the at least one fluid inlet and the additional fluid outlet, are arranged under the interior of the delay container, so that evacuation can take place through the additional fluid outlet on the second side of the delay container through exposure to gravity, without using a fluid conveying device.

In a preferred further development of the alarm valve station according to the invention, the at least one fluid inlet on the second side of the delay container is not aligned flush with any of the several fluid outlets on the first side of the delay container. The extinguishing fluid streaming into the delay container through the at least one fluid inlet routinely has a pressure level that leads to the formation of an extinguishing fluid jet, in particular when the delay container first starts being filled. The risk of a flush alignment of the at least one fluid inlet relative to one of the several fluid outlets is that, even though the delay container has not yet been completely or essentially completely filled with extinguishing fluid, extinguishing fluid already flows out via the extinguishing fluid jet through the fluid outlet aligned flush with the fluid inlet, and the pressure sensor generates an alarm signal without a delay or with too short a delay.

In an advantageous embodiment of the alarm valve station according to the invention, the delay container has a longitudinal axis that extends from the first side to the second side of the delay container. A fluid inlet or several or all fluid inlets are spaced apart from the longitudinal axis. Alternatively or additionally, a fluid outlet or several or all fluid outlets of the delay container are spaced apart from the longitudinal axis. At least sections of the delay container are preferably designed rotationally symmetrical around a central axis, wherein the longitudinal axis corresponds to the central axis. By being spaced apart from the longitudinal axis, the respective fluid inlet or the respective fluid outlet is arranged on the side of the delay container. Each fluid inlet and fluid outlet can be fluidically connected with a pipe section or some other component by means of a suitable coupling means, for example a pipe fitting. Despite a plurality of fluid inlets and/or fluid outlets, the lateral arrangement of the respective fluid inlets and respective fluid outlets allows this coupling. As a whole, the delay container can in this way be integrated into the alarm valve station in a space-saving manner.

The alarm valve station according to the invention is advantageously further developed in such a way as to give the delay container a multipart design. The multipart design of the delay container makes it easier to manufacture the delay container on the one hand, and increases the adaptability of the delay container on the other. Furthermore, the delay container is easier to assemble and maintain.

In an especially preferred embodiment of the alarm valve station according to the invention, the delay container has a first container part and a second container part that can be detached, preferably reversibly and nondestructively detached, from the first container part. The two separate and detachable container parts further increase the universality of the delay container.

Further preferred is an alarm valve station according to the invention in which the first container part and second container part each have a flange section, wherein the flange sections of the first container part and second container part are designed to be mutually connected. The respective flange section is preferably integrally designed with the respective container part. It is further preferred that the flange section of the first container part and flange section of the second container part be designed as a continuous flange section. The flange section of the first container part and flange section of the second container part preferably extend radially outward from the interior of the respective container part.

In another preferred embodiment of the alarm valve station according to the invention, the first container part and second container part are identical. This leads to a significant reduction in production costs, for example the model costs for fabricating cast parts. In particular, the first container part of the delay container has several, preferably two, fluid outlets. In particular, the second container part of the delay container has at least one fluid inlet. The second container part of the delay container further preferably has a fluid outlet in addition to the fluid inlet.

The alarm valve station according to the invention is further advantageously further developed by virtue of the fact that the first container part and second container part can be connected with each other in various rotational angle positions. Because the first container part and second container part can be connected with each other in various rotational angle positions, the position of the fluid outlets and the at least one fluid inlet of the delay container can be altered. For example, the first container part and second container part can be connected with each other in a total of 4 different rotational angle positions, wherein

- in a first rotational angle position, the first container part and second container part are not twisted, i.e., the terminals are aligned flush,
- in a second rotational angle position, the first container part and second container part are twisted relative to each other by a total of 90 degrees around a central axis of the delay container,
- in a third rotational angle position, the first container part and second container part are twisted relative to each other by a total of 180 degrees around a central axis of the delay container,
- in a fourth rotational angle position, the first container part and second container part are twisted relative to each other by a total of 270 degrees around a central axis of the delay container.

Further preferred as well are delay containers whose first container part and whose second container part can be connected with each other in a total of two, three, four, five, six, seven, eight, nine or ten different rotational angle positions. The first container part preferably has a number of boreholes on the flange section, and the second container part has an identical number of boreholes, wherein the number of boreholes in the respective container parts corresponds to the number of possible rotational angle positions. The first container part and second container part preferably each have a total of two, three, four, five, six, seven, eight, nine or ten boreholes.

In a preferred embodiment of the alarm valve station according to the invention, a gasket element is arranged between the first container part and second container part, which protrudes into the interior of the delay container.

In an advantageous embodiment of the alarm valve station according to the invention, the fluid inlet or fluid inlets of the delay container each have a central axis, wherein the gasket element protrudes into the interior of the delay container in such a way that the central axis of the one fluid inlet or several fluid inlets intersects the gasket element. As a consequence, the gasket element serves as an impact element for extinguishing fluid entering into the delay container. The gasket element preferably has an elastic sealing lip, which preferably extends into the interior of the delay container.

Also preferred is an alarm valve station according to the invention in which the fluid inlet or fluid inlets of the delay container is/are aligned flush with one or several fluid outlets of the delay container. The flush alignment of the fluid inlet or fluid inlets of the delay container relative to one or several fluid outlets of the delay container is preferred in particular when the delay container has a gasket element that acts as an impact element. Even given a flush alignment of the fluid inlet or fluid inlets of the delay container relative to one or several fluid outlets of the delay container, the impact element eliminates any risk that an extinguishing fluid jet will form between a fluid inlet and fluid outlet within the delay container, and that the pressure sensor will generate an electrical signal without a delay or with too little a delay.

In an advantageous further development of the alarm valve station according to the invention, a fluid outlet of the delay container is fluidically connected with an evacuation device, which is set up to automatically empty the delay container. Alternatively or additionally, a fluid inlet of the delay container temporarily also serves as a fluid outlet. Several, in particular two fluid outlets are preferably arranged on a first side of the delay container, and a fluid inlet and a fluid outlet fluidically connected with the delay container are preferably arranged on an opposing second side of the delay container. In particular, the first container part of the delay container has several, in particular two fluid outlets, and the second container part of the delay container has a fluid inlet and a fluid outlet fluidically connected with the evacuation device. A dirt trap, one or more throttles and/or stop valves are preferably arranged between the alarm valve and delay container, or between the alarm valve and alarm system.

In the standby mode of the fire extinguishing system, i.e., when no sprinkler of the fire extinguishing system is open, a check valve preferably prevents the pressure in the pipe network of the sprinkler arrangement from falling while the extinguishing fluid supply pressure is sinking. As a consequence, the operational readiness of the fire extinguishing system is upheld even given a drop in the extinguishing fluid supply pressure. Given a renewed rise in the extinguishing fluid supply pressure, the check valve also reduces the risk that water will flow into the pipe network of the sprinkler arrangement, and thereby inadvertently trigger an alarm.

The delay container is preferably made out of plastic or stainless steel.

The object underlying the invention is also achieved with a fire extinguishing system, an alarm valve station, an extinguishing fluid supply and a sprinkler arrangement. The alarm valve station of the fire extinguishing system according to the invention is designed based on one of the embodiments described above. The extinguishing fluid supply is fluidically connected with the extinguishing fluid inlet of the alarm valve. The sprinkler arrangement is fluidically connected with the extinguishing fluid outlet of the alarm valve. With respect to the advantages of the fire extinguishing system according to the invention, reference is made to the advantages of the alarm valve station according to the invention.

BRIEF DESCRIPTION OF THE DRAWINGS

Preferred embodiments of the invention will be explained and described in more detail below with reference to the attached drawings. Shown on.

MODE(S) FOR CARRYING OUT THE INVENTION

Figure 1:
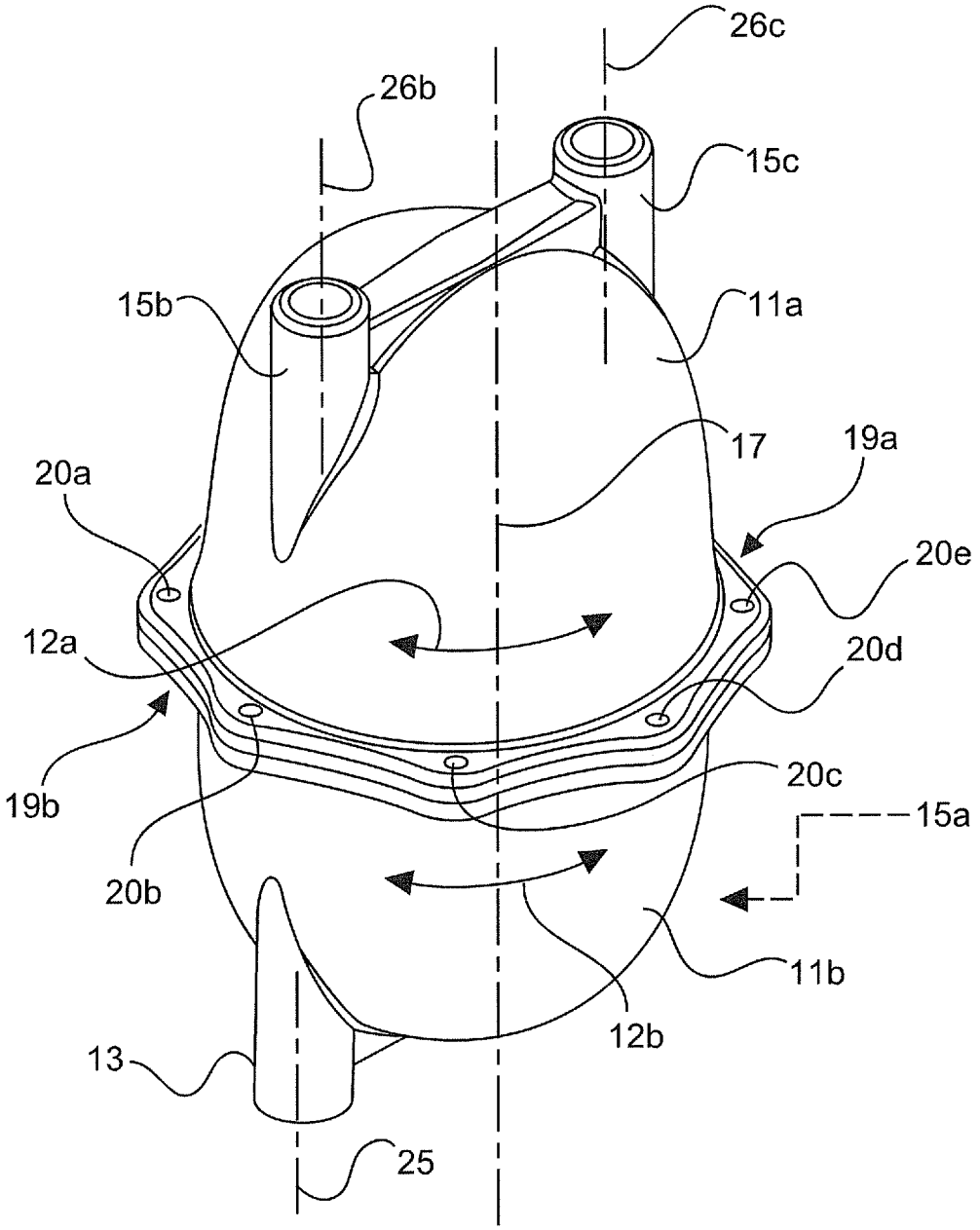
FIG. 1 is a perspective view of an exemplary embodiment of a delay container of the alarm valve station according to the invention.
Figure 2:
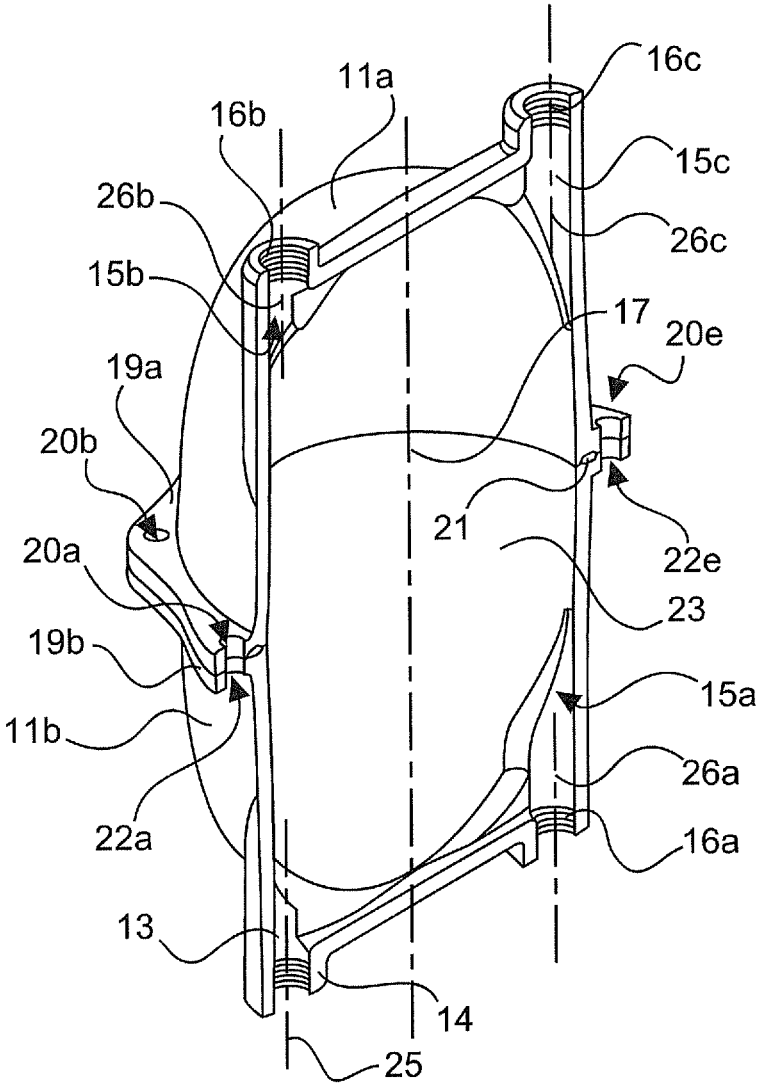
FIG. 2 is a sectional view of the delay container from FIG. 1.

On FIG. 1 and FIG. 2, the delay container 11*a*, 11*b* has a fluid inlet 13 and three fluid outlets 15*a*-15*c*.

Two fluid outlets 15*b*, 15*c* are arranged on a first side of the delay container 11*a*, 11*b*, while a fluid inlet 13 and a fluid outlet 15*a* in addition to the fluid inlet 13 are arranged on a second, opposing side of the delay container 11*a*, 11*b*.

The delay container 11*a*, 11*b* has a longitudinal axis 17, which extends from the first side to the second side of the delay container 11*a*, 11*b*. The fluid inlet 13 and fluid outlets 15*a*-15*c* of the delay container 11*a*, 11*b* are spaced apart from the longitudinal axis 17.

The delay container 11*a*, 11*b* has multiple parts, and sections thereof are designed rotationally symmetrical around a central axis, wherein the longitudinal axis 17 corresponds to the central axis. The first container part 11*a* and the second container part 11*b* that can be reversibly and nondestructively detached from the first container part 11*a* are connected with each other via flange sections 19*a*, 19*b*. The first container part 11*a* and second container part 11*b* are identical.

The first container part 11*a* of the delay container 11*a*, 11*b* has two fluid outlets 15*b*, 15*c*. The second container part 11*b* of the delay container 11*a*, 11*b* has a fluid inlet 13 and a fluid outlet 15*a* in addition to the fluid inlet 13.

The first container part 11*a* and second container part 11*b* can be connected with each other at eight different rotational angle positions. The first container part 11*a* can be rotated around the longitudinal axis 17 in the rotational directions 12*a*. The second container part 11*b* can be rotated around the longitudinal axis in the rotational directions 12*b*.

The first container part 11*a* has eight boreholes 20*a*-20*e* in the flange section 19*a*, while the second container part 11*b* also has eight boreholes 22*a*-22*e* in the flange section 19*b*.

Figure 3:
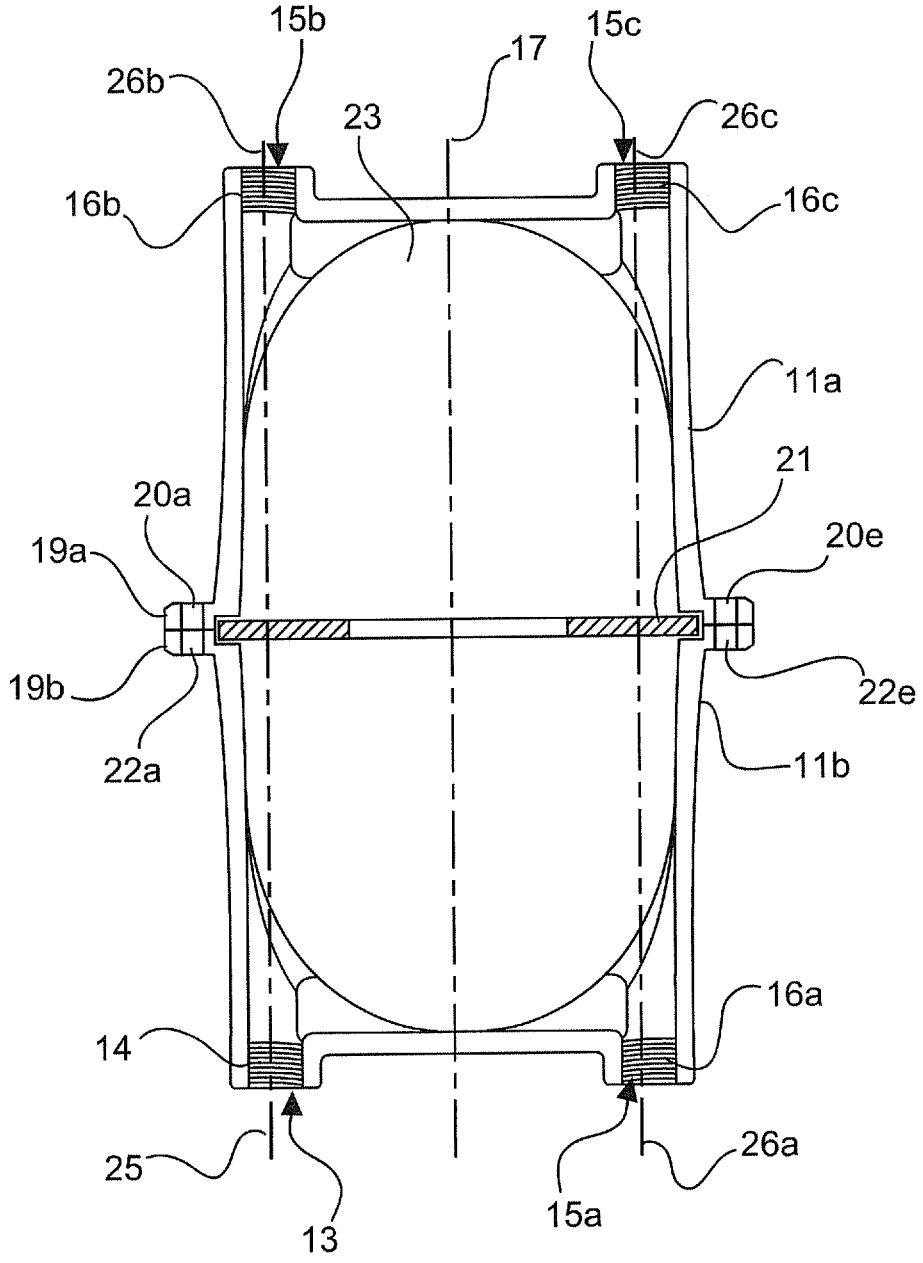
FIG. 3 is another sectional view of the delay container from FIG. 1.

As evident from FIG. 3, a gasket element 21 can be arranged between the first container part 11*a* and second container part 11*b*, which protrudes into the interior 23 of the delay container 11*a*, 11*b*. The fluid inlet 13 of the delay container 11*a*, 11*b* has a central axis 25, wherein the gasket element 21 protrudes into the interior space 23 of the delay container 11*a*, 11*b* in such a way that the central axis 25 of the fluid inlet 13 intersects the gasket element 21. The fluid inlet 13 of the delay container 11*a*, 11*b* is aligned flush with the fluid outlet 15*b* of the delay container 11*a*, 11*b*. The gasket element 21 serves as an impact element for the fluid entering into the delay container 11*a*, 11*b*. The gasket element 21 consists of an elastic sealing lip, which extends into the interior 23 of the delay container 11*a*, 11*b*.

The fluid inlet 13 of the delay container 11*a*, 11*b* has a threaded section 14. The fluid outlets 15*a*-15*c* of the delay container 11*a*, 11*b* also each have a threaded section 16*a*-16*c*.

Figure 4:
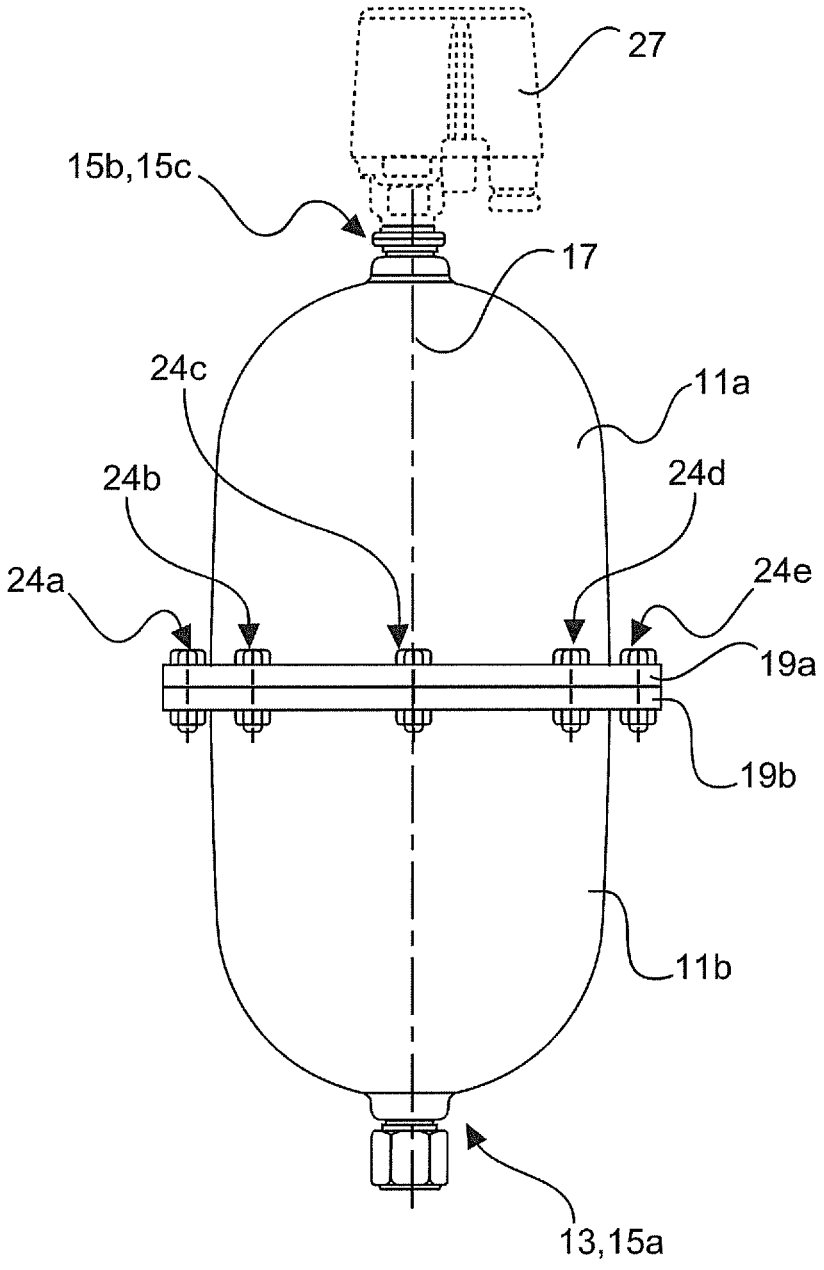
FIG. 4 is a side view of another exemplary embodiment of a delay container of the alarm valve station according to the invention.

According to FIG. 4, the first container part 11*a* and second container part 11*b* of the delay container 11*a*, 11*b* are connected with each other by eight screw fittings (24*a*-24*e*). The fluid outlets 15*b*, 15*c* of the delay container 11*a*, 11*b* lying one behind the other on FIG. 4 are each connected with alarm triggering devices, which have a pressure sensor 27. The pressure sensor 27 is designed as a pressure switch, and set up to detect a pressure change and convert it into an electrical signal.

Figure 5:
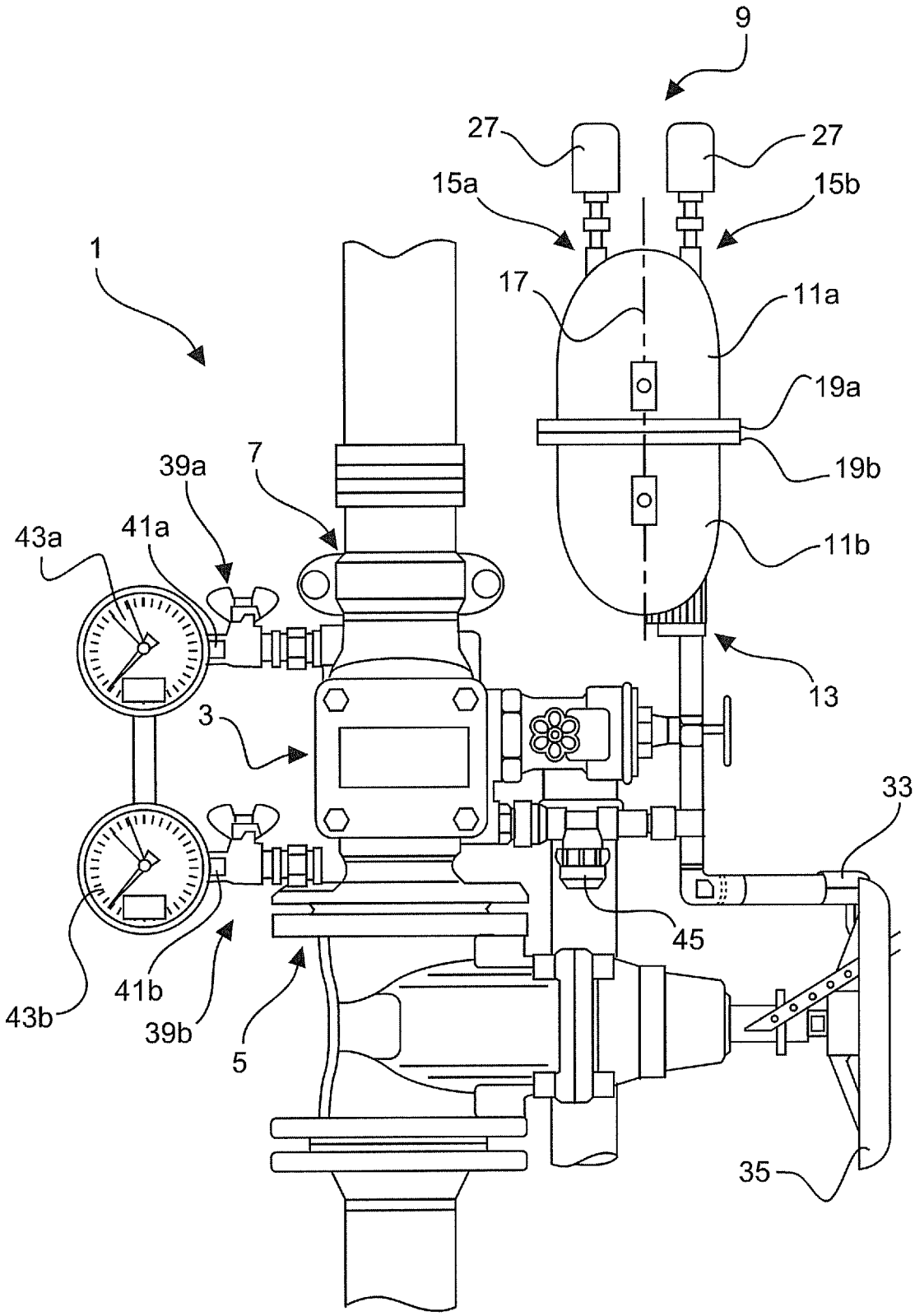
FIG. 5 is a side view of an exemplary embodiment of the alarm valve station according to the invention.
Figure 6:
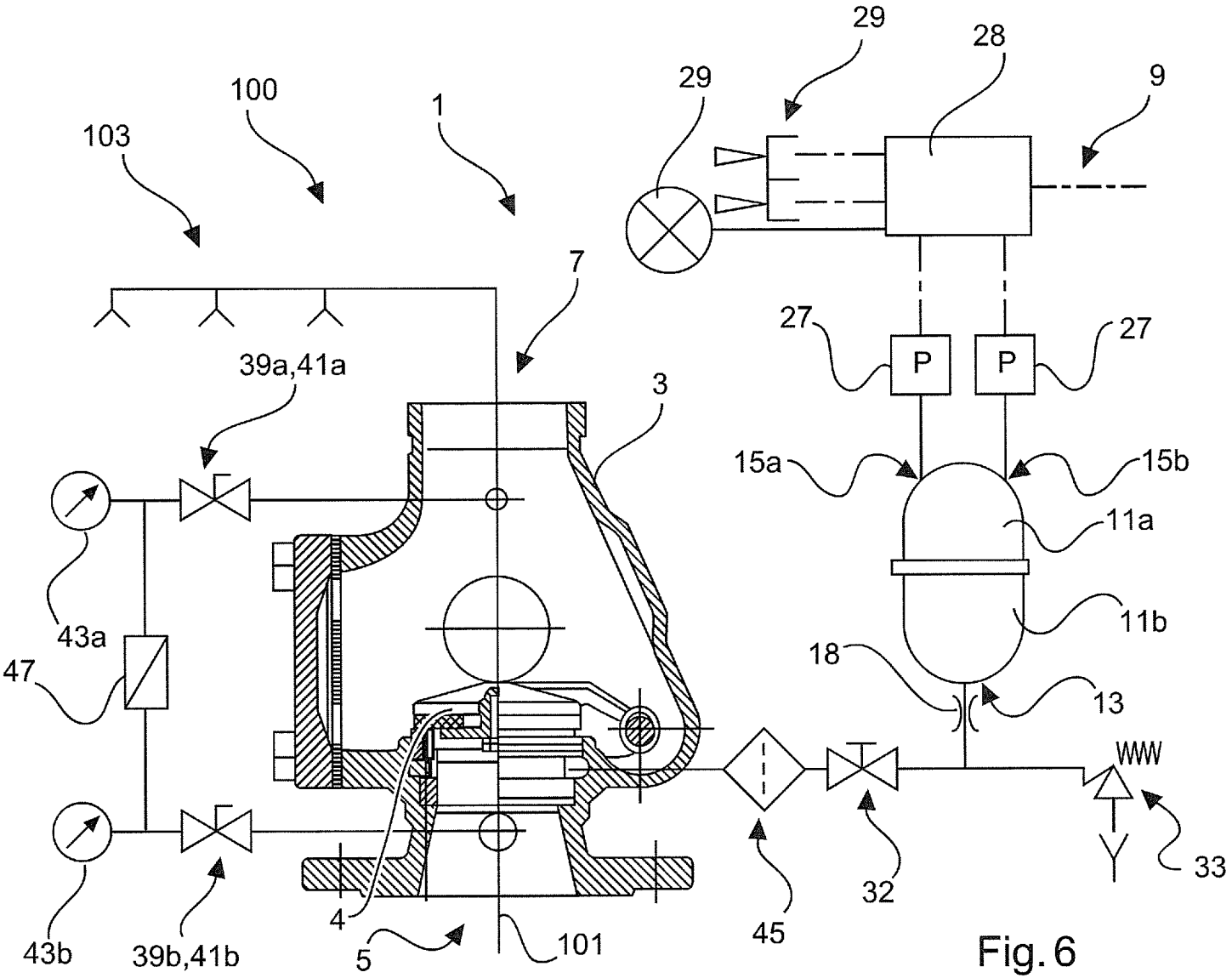
FIG. 6 is a schematic view of an exemplary embodiment of the fire extinguishing system according to the invention.

FIG. 5 shows an alarm valve station 1 with an alarm valve 3, an alarm triggering device 9 and a delay container 11*a*, 11*b*. The alarm valve 3 consists of an extinguishing fluid inlet 5 and an extinguishing fluid outlet 7, wherein the alarm valve 3 is set up to detect the extinguishing fluid flow between the extinguishing fluid inlet 5 and extinguishing fluid outlet 7. The extinguishing fluid inlet 5 of the alarm valve 3 is set up to be fluidically connected with an extinguishing fluid supply 101 (FIG. 6). The extinguishing fluid outlet 7 of the alarm valve 3 is set up to be fluidically connected with a sprinkler arrangement 103 (FIG. 6). The alarm valve 3 is set up to release the inflow of extinguishing fluid into the alarm line upon opening one or several sprinklers of the sprinkler arrangement 103.

The alarm triggering device 9 is designed to trigger a fire alarm, and connected with the alarm valve 3. In order to trigger a fire alarm, the alarm triggering device 9 has two pressure sensors 27 designed as a pressure switch, wherein the pressure sensors are each connected with a fluid outlet 15*a*, 15*b* of the delay container 11*a*, 11*b*. The delay container 11*a*, 11*b* serves to delay the triggering of the fire alarm. In the event of a fire, the alarm valve 3 is fluidically connected with the fluid inlet 13 of the delay container 11*a*, 11*b*.

The first pressure sensor 27 is connected with a fire detector and/or extinguishing control panel in a signal-conducting manner. The second pressure sensor 27 is connected with an electrically operated alarm system in a signal-conducting manner. The electrically operated alarm system consists of an alarm horn (not shown).

The fluid inlet 13 of the delay container 11*a*, 11*b* is aligned flush with the fluid outlet 15*b* of the delay container 11*a*, 11*b*.

The fluid inlet 13 of the delay container 11*a*, 11*b* also serves as a fluid outlet, and is fluidically connected with an evacuation device 33. The evacuation device 33 is set up to automatically empty the delay container 11*a*, 11*b*.

A dirt trap 45 is arranged between the alarm valve 3 and delay container 11*a*, 11*b*.

In order to manually release the extinguishing fluid flow, the alarm valve station 1 has a shutoff unit 35, by means of which the extinguishing fluid flow can be released and blocked.

The extinguishing fluid inlet 5 and extinguishing fluid outlet 7 of the alarm valve 3 are connected with each other via a bypass line. The intermediate line has two stopcocks 39*a*, 39*b*, two vent valves 41*a*, 41*b* and two manometers 43*a*, 43*b*.

FIG. 6 shows a fire extinguishing system 100 with an alarm valve station 1, an extinguishing fluid supply 101, which is fluidically connected with the extinguishing fluid inlet 5 of the alarm valve 3, and a sprinkler arrangement 103, which is fluidically connected with the extinguishing fluid outlet 7 of the alarm valve. The extinguishing fluid inlet 5 and extinguishing fluid outlet 7 of the alarm valve 3 are also connected with each other via a bypass line. The bypass line has two stopcocks 39*a*, 39*b*, two vent valves 41*a*, 41*b*, two manometers 43*a*, 43*b* and a check valve 47.

The alarm valve has a closing body 4, which can be moved back and forth between a blocking state and a release state, wherein the fluid inlet chamber and fluid outlet chamber are separated from each other in the blocking state, and communicate with each other fluidically in the release state. FIG. 6 shows the blocking state.

A dirt trap 45, a shutoff valve 32 and a throttle 18 are arranged between the alarm valve 3 and delay container 11*a*, 11*b*. The delay container 11*a*, 11*b* has a multipart design, with a first container part 11*a* and a second container part 11*b*.

The first container part 11*a* of the delay container 11*a*, 11*b* has two fluid outlets 15*a*, 15*b*. The second container part 11*b* of the delay container 11*a*, 11*b* has one fluid inlet 13. The fluid inlet 13 simultaneously serves as a fluid outlet, and is fluidically connected with the evacuation device 33.

The two fluid outlets 15*a*, 15*b* are each fluidically connected with a pressure sensor 27. The two pressure sensors 27 are designed as pressure switches, and connected with a fire detector and/or extinguishing control panel 28 in a signal-conducting manner. The fire detector and/or extinguishing control panel 28 is connected with two electrically operated alarm systems 29 in a signal-conducting manner. The first electrically operated alarm system 29 is designed as an alarm horn. The second electrically operated alarm system 29 is designed as an optical warning unit. The pressure sensors 27, fire detector and/or extinguishing control panel 28 and electrically operated alarm systems 29 are part of the alarm triggering device 9.

Figure 7:
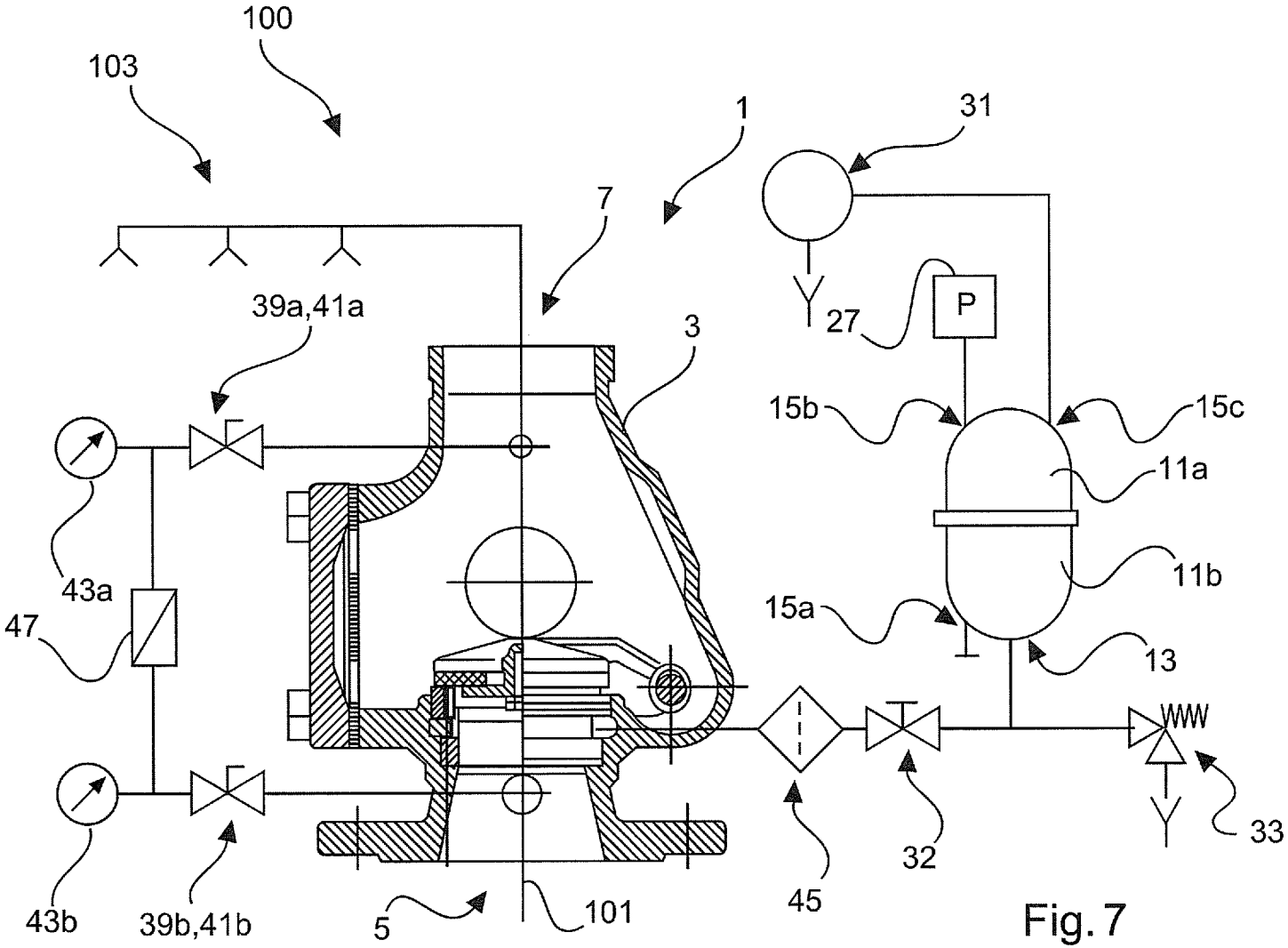
FIG. 7 is a schematic view of another exemplary embodiment of the fire extinguishing system according to the invention.

FIG. 7 also shows a fire extinguishing system 100 with a hydraulic delay container 11*a*, 11*b*, wherein the delay container 11*a*, 11*b* has a fluid inlet 13 and three fluid outlets 15*a*-15*c*. The fluid outlet 15*a* is closed, and has no function. The fluid outlet 15*b* is fluidically connected with a pressure sensor 27 designed as a pressure switch. The fluid outlet 15*c* is fluidically connected with a hydraulically operated alarm system 31. The hydraulically operated alarm system 31 consists of a hydraulic alarm bell. The alarm bell serves to sound an alarm in the immediate environment. Otherwise, the structural design of the fire extinguishing system 100 corresponds to the structural design of the fire extinguishing system 100 from FIG. 6.

Figure 8:
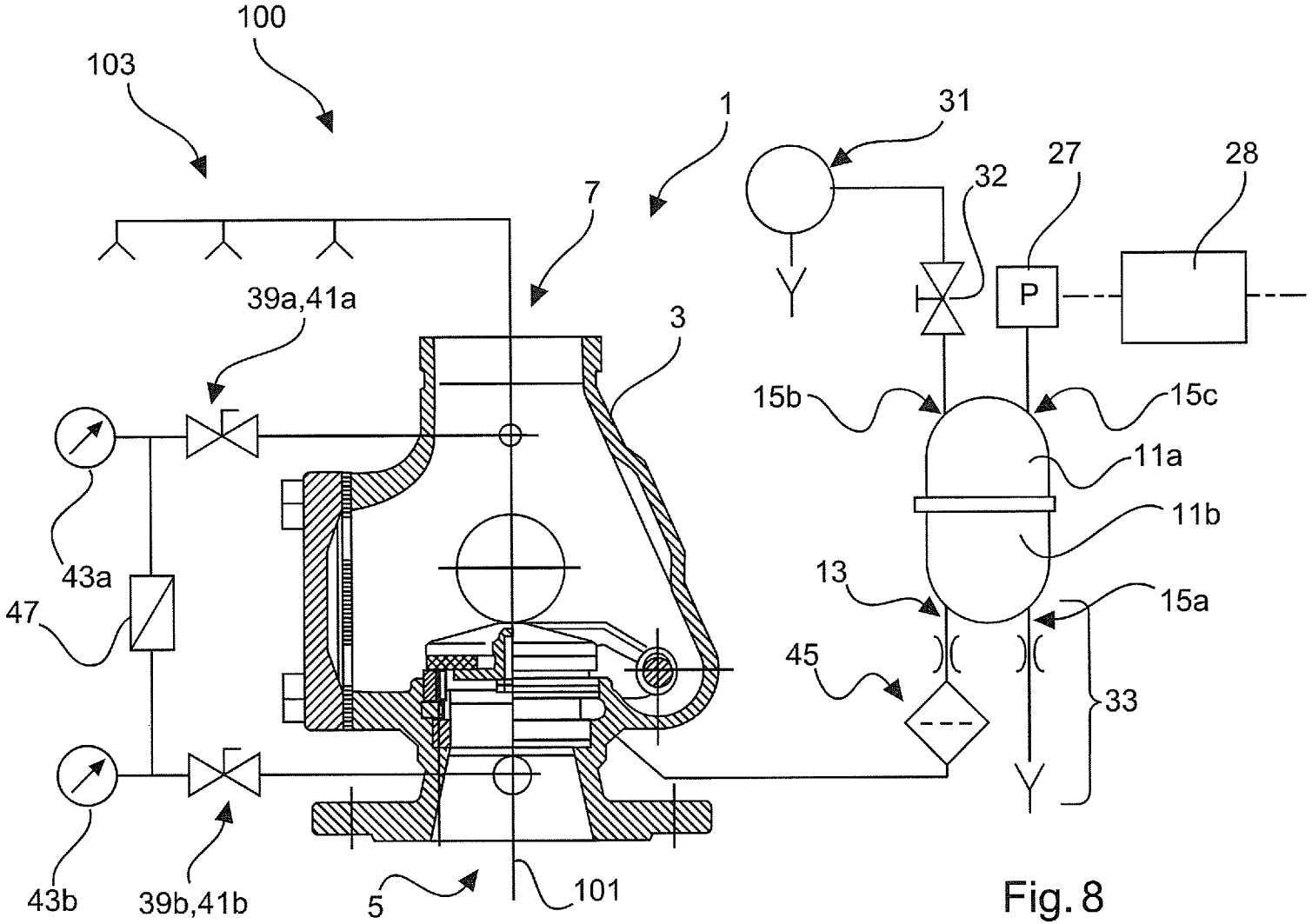
FIG. 8 is a schematic view of another exemplary embodiment of the fire extinguishing system according to the invention.

FIG. 8 also shows a fire extinguishing system 100 with a hydraulic delay container 11*a*, 11*b*, wherein the delay container 11*a*, 11*b* has a fluid inlet 13 and three fluid outlets 15*a*-15*c*. The fluid outlet 15*a* is fluidically connected with an evacuation device 33. The fluid outlet 15*b* is fluidically connected with a hydraulically operated alarm system 31 by way of a shutoff valve 32. The hydraulically operated alarm system 31 consists of a hydraulic alarm bell. The fluid outlet 15*c* is fluidically connected with a pressure sensor 27 designed as a pressure switch. The pressure sensor 27 is in turn connected with a fire detector and/or extinguishing control panel 28 in a signal-conducting manner. Otherwise, the structural design of the fire extinguishing system 100 corresponds to the structural design of the fire extinguishing system 100 from FIG. 6 and FIG. 7.

Figure 9:
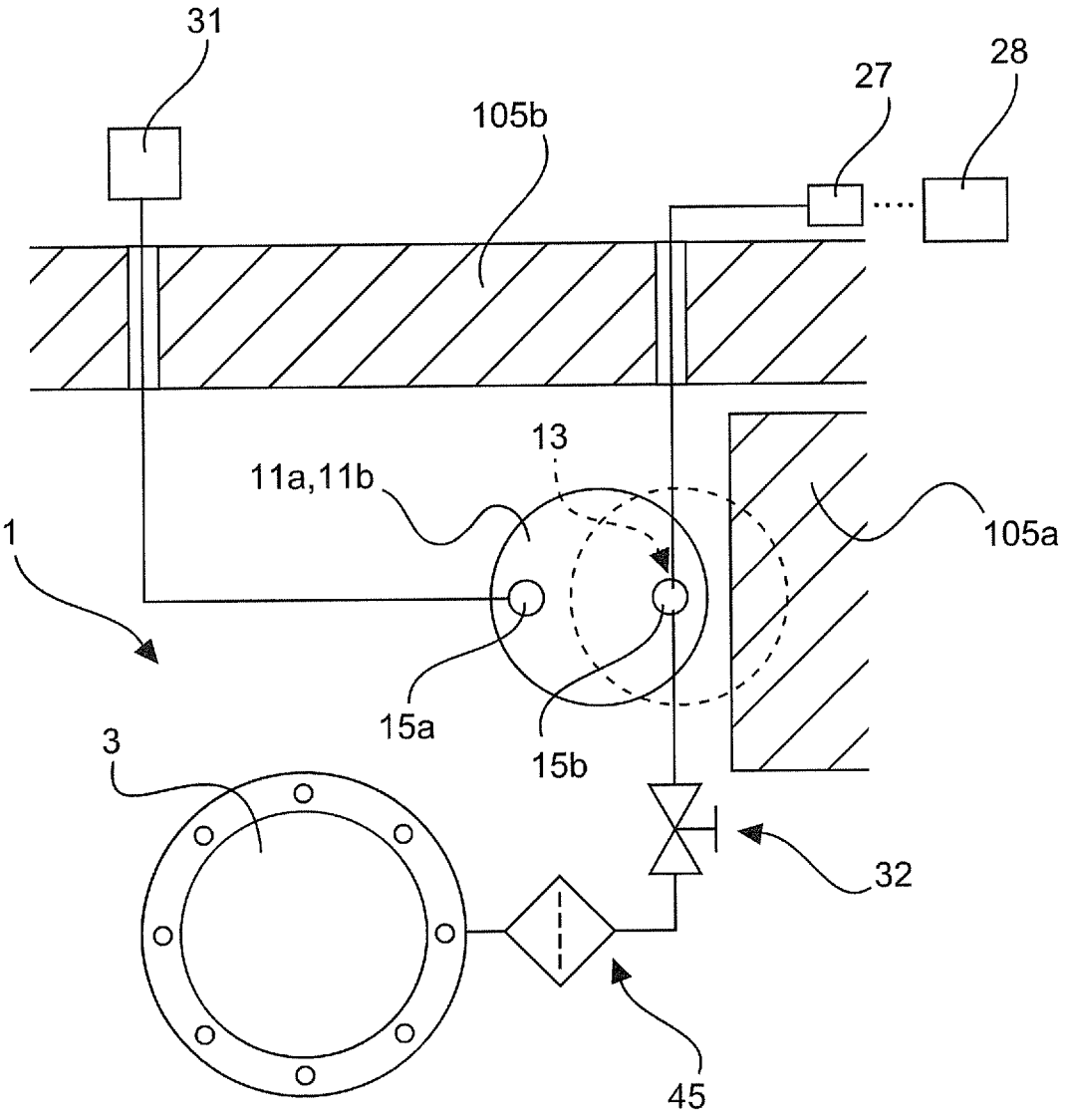
FIG. 9 is a top view of an exemplary embodiment of the alarm valve station according to the invention.

The top view on FIG. 9 shows an alarm valve station 1 according to the invention, which is arranged in the area of two wall sections 105*a*, 105*b*. The alarm valve 3 is fluidically connected with the fluid inlet 13 of the delay container 11*a*, 11*b* via a dirt trap 45 and shutoff valve 32. The fluid outlet 15*a* of the delay container 11*a*, 11*b* is fluidically connected with a hydraulically operated alarm system 31, which is designed as a hydraulic alarm bell. The fluid outlet 15*b* is fluidically connected with the pressure sensor 27. The pressure sensor 27 is connected with the fire detector and/or extinguishing control panel 28 in a signal-conducting manner. The lateral arrangement of the fluid inlet 13 and fluid outlets 15*a*, 15*b* makes it possible to lay the line sections connected with the fluid inlet 13 and fluid outlet 15*b* in directly proximity to the wall section 105*a*. The dashed line denotes that routing the lines in such a space-saving manner would not be possible with a known delay container. Using a delay container with a fluid inlet/outlet offset from the longitudinal axis or middle of the container enables an eccentric arrangement of the container relative to the line sections. In the arrangement shown, the longitudinal axis of the delay container is offset toward the left relative to the line sections, which are connected to the fluid inlet 13 and fluid outlet 15*b*. As a result of this offset arrangement, the alarm valve station takes up less area and width than would a concentric arrangement of the delay container (dashed line).

LIST OF UTILIZED REFERENCE NUMBERS

1 Alarm valve station
3 Alarm valve
4 Closing body
5 Extinguishing fluid inlet
7 Extinguishing fluid outlet
9 Alarm triggering device
11*a*, 11*b* Delay container
12*a*, 12*b* Rotational directions of the container parts
13 Fluid inlet of the delay container
14 Threaded section
15*a*-15*c* Fluid outlets of the delay container
16*a*-16*c* Threaded sections
17 Longitudinal axis
18 Throttle
19*a*, 19*b* Flange sections
20*a*-20*e* Boreholes in the first flange section
21 Gasket element
22*a*-22*e* Boreholes in the second flange section
23 Interior of the delay container
24*a*-24*e* Screw fittings
25 Central axis
26*a*-26*c* Central axes
27 Pressure sensor
28 Fire detector and/or extinguishing control panel
29 Electrically operated alarm system
31 Hydraulically operated alarm system
32 Shutoff valve
33 Evacuation device
35 Shutoff unit
39*a*, 39*b* Stopcocks
41*a*, 41*b* Vent valves
43*a*, 43*b* Manometer
45 Dirt trap
47 Check valve
100 Fire extinguishing system
101 Extinguishing fluid supply
103 Sprinkler arrangement
105*a*, 105*b* Wall sections

The invention claimed is:

1. An alarm valve station of a fire extinguishing system, comprising:

an alarm valve with an extinguishing fluid inlet and an extinguishing fluid outlet, wherein the alarm valve has a closing body that can be moved back and forth between a blocking state and a release state, wherein a fluid inlet chamber and a fluid outlet chamber are separated from one another in the blocking state and communicate with one another fluidically in the release state, an alarm triggering device for triggering a fire alarm, which is connected with the alarm valve, and a delay container in order to delay triggering of the fire alarm, wherein the alarm valve is fluidically connected with a fluid inlet of the delay container, and a fluid outlet of the delay container is fluidically connected with the alarm triggering device, wherein the delay container has a chamber centered in the delay container and a central longitudinal axis that extends from a first side to a second opposing side along the chamber, the first side having several fluid outlets, the second side having at least one fluid inlet, and wherein the at least one fluid inlet and/or the several fluid outlets comprises a central axis parallel to and spaced apart from the longitudinal axis.

2. The alarm valve station according to claim 1, wherein the several fluid outlets are connected with the alarm triggering device or several respective alarm triggering devices.

3. The alarm valve station according to claim 1, wherein the at least one fluid inlet on the second side of the delay container is not aligned flush with any of the several fluid outlets on the first side of the delay container.

4. The alarm valve station according to claim 1, wherein the delay container has a multipart design.

5. The alarm valve station according to claim 1, wherein the delay container has a first container part and a second container part that are detachable.

6. The alarm valve station according to claim 5, wherein the first container part and second container part each have a flange section, wherein the flange sections of the first container part and second container part are designed to be mutually connected.

7. The alarm valve station according to claim 5, wherein the first container part and second container part are identical.

8. The alarm valve station according to claim 5, wherein the first container part is connectable to the second container part at various rotational angle positions.

9. The alarm valve station according to claim 5, wherein a gasket element is arranged between the first container part and second container part, which protrudes into the chamber of the delay container.

10. The alarm valve station according to claim 9, wherein the gasket element protrudes into the chamber of the delay container in such a way that the central axis of the at least one fluid inlet intersects the gasket element.

11. The alarm valve station according to claim 1, wherein the at least one fluid inlet of the delay container is aligned flush with at least one of the several fluid outlets of the delay container.

12. A fire extinguishing system, having an alarm valve station according to claim 1, an extinguishing fluid supply that is fluidically connected with the extinguishing fluid inlet of the alarm valve, and a sprinkler arrangement that is fluidically connected with the extinguishing fluid outlet of the alarm valve.

13. An alarm valve station of a fire extinguishing system, comprising:

an alarm valve with an extinguishing fluid inlet and an extinguishing fluid outlet, wherein the alarm valve has a closing body that can be moved back and forth between a blocking state and a release state, wherein a fluid inlet chamber and a fluid outlet chamber are separated from one another in the blocking state and communicate with one another fluidically in the release state, an alarm triggering device for triggering a fire alarm, which is connected with the alarm valve, and a delay container upstream of the alarm triggering device in order to delay triggering of the fire alarm, wherein the delay container has a first container part connectable to a second container part at a plurality of rotational angle positions, wherein the first container part includes several fluid outlets, at least one of the several fluid outlets fluidically connected with the alarm triggering device, and wherein the second container part includes at least one fluid inlet fluidically connected to the alarm valve.

14. The alarm valve station according to claim 13, wherein the several fluid outlets of the delay container are connected with the alarm triggering device or several respective alarm triggering devices.

15. The alarm valve station according to claim 13, wherein the at least one fluid inlet is not aligned flush with any of the several fluid outlets.

16. The alarm valve station according to claim 13, wherein the delay container has a longitudinal axis that extends from a first side to a second side of the delay container, and the at least one fluid inlet and/or at least one of the several or all of the several fluid outlets are spaced apart from the longitudinal axis.

17. The alarm valve station according to claim 13, wherein the first container part and the second container part are detachable.

18. The alarm valve station according to claim 17, wherein the first container part and second container part each have a flange section, wherein the flange sections of the first container part and second container part are designed to be mutually connected.

19. The alarm valve station according to claim 18, wherein the first container part and second container part are identical.

20. The alarm valve station according to claim 19, wherein a gasket element is arranged between the first container part and second container part, wherein the at least one fluid inlet has a central axis, and wherein the gasket element protrudes into an interior of the delay container in such a way that the central axis of the at least one fluid inlet intersects the gasket element.

21. The alarm valve station according to claim 13, wherein the at least one fluid inlet is aligned flush with at least one of the several fluid outlets.

22. A fire extinguishing system, having an alarm valve station according to claim 13, an extinguishing fluid supply that is fluidically connected with the extinguishing fluid inlet of the alarm valve, and a sprinkler arrangement that is fluidically connected with the extinguishing fluid outlet of the alarm valve.

* * * * *